US008715143B2

(12) United States Patent
Svenberg et al.

(10) Patent No.: US 8,715,143 B2
(45) Date of Patent: May 6, 2014

(54) DUMBBELL

(75) Inventors: Tomas Svenberg, Huskvarna (SE); Per Höglund, Jönköping (SE)

(73) Assignee: Tomas Svenberg, Huskvarna (SE)

( * ) Notice: Subject to any disclaimer, the term of this patent is extended or adjusted under 35 U.S.C. 154(b) by 289 days.

(21) Appl. No.: 12/744,972

(22) PCT Filed: Nov. 27, 2008

(86) PCT No.: PCT/SE2008/000659
§ 371 (c)(1),
(2), (4) Date: May 27, 2010

(87) PCT Pub. No.: WO2009/070082
PCT Pub. Date: Jun. 4, 2009

(65) Prior Publication Data

US 2010/0304939 A1 Dec. 2, 2010

(30) Foreign Application Priority Data

Nov. 29, 2007 (SE) ..... 0702656

(51) Int. Cl.
*A63B 21/072* (2006.01)
*A63B 21/075* (2006.01)

(52) U.S. Cl.
USPC ..... 482/108; 482/106

(58) Field of Classification Search
USPC ..... 482/50, 92, 93, 94, 97, 98, 104, 105, 482/106, 107, 108, 109, 148, 908; D21/681; 211/85.7
See application file for complete search history.

(56) References Cited

U.S. PATENT DOCUMENTS

| | | | | |
|---|---|---|---|---|
| 6,228,003 | B1 | 5/2001 | Hald | |
| 6,416,446 | B1 * | 7/2002 | Krull | 482/108 |
| 7,121,988 | B2 * | 10/2006 | Walkerdine | 482/106 |
| 7,137,932 | B2 * | 11/2006 | Doudiet | 482/107 |
| 7,233,214 | B2 * | 6/2007 | Kim et al. | 331/176 |
| 7,285,078 | B1 | 10/2007 | Liu | |

(Continued)

FOREIGN PATENT DOCUMENTS

WO 2007123461 A1 11/2007

OTHER PUBLICATIONS

International Preliminary Report on Patentability for corresponding International App. PCT/SE2008/00659.

(Continued)

*Primary Examiner* — Loan H Thanh
*Assistant Examiner* — Sundhara Ganesan
(74) *Attorney, Agent, or Firm* — WRB-IP LLP

(57) ABSTRACT

A dumbbell with a selectable number of weight disks includes a handle with pins projectable in opposing directions, a base assembly for accommodating two sets of weight disks standing upright, and having through-going openings. Neighboring weight disks have mutually cooperating connecting arrangements which axially interconnect the weight disks but which permit radial separation. The projection lengths of the pins are stepwise selectable in order thereby to permit selection of the number of weight disks carried on the handle. The handle has, in opposing ends, connecting arrangements for interconnecting with the connecting arrangements of the innermost weight disks in the base assembly. Further, the space between the connecting arrangements of the handle is free through 360° about the handle throughout its entire length, the openings of the weight disks being centrally located.

15 Claims, 8 Drawing Sheets

(56) References Cited

U.S. PATENT DOCUMENTS

| | | | | |
|---|---|---|---|---|
| 7,377,885 | B2 * | 5/2008 | Doudiet | 482/107 |
| 7,485,077 | B2 * | 2/2009 | Chen | 482/108 |
| 7,491,155 | B2 * | 2/2009 | Fenelon et al. | 482/107 |
| 7,614,982 | B2 * | 11/2009 | Crawford et al. | 482/107 |
| 7,862,487 | B2 * | 1/2011 | Olson | 482/108 |
| 2008/0188362 | A1 | 8/2008 | Chen | |
| 2009/0042700 | A1 | 2/2009 | Liu | |
| 2009/0156376 | A1 * | 6/2009 | Fenelon et al. | 482/108 |
| 2010/0304940 | A1 * | 12/2010 | Svenberg et al. | 482/108 |
| 2010/0323856 | A1 * | 12/2010 | Svenberg et al. | 482/108 |

OTHER PUBLICATIONS

International Search Report for corresponding International Application PCT/SE2008/000660.

* cited by examiner

DUMBBELL

BACKGROUND AND SUMMARY

The present invention relates to a dumbbell with a base assembly, where, at each end of a handle, there are securable a selectable number of weight disks standing upright in the base assembly, the weight disks having through-going openings which are disposed in alignment with one another, when the weight disks stand in the base assembly, and the weight disks have mutually cooperating connecting means which are disposed, in the axial direction of the dumbbell, to interconnect neighbouring weight disks, but in a radial direction to permit separation of one weight disk from a neighbouring weight disk, and the handle having pin members projectable in opposing axial directions and insertable into the weight disks, whereby, by selection of the axial projection lengths of the pin members, the number of weight disks on the dumbbell is selectable.

U.S. Pat. No. 6,416,446 discloses a dumbbell which comprises a base unit or assembly with two sets of weight plates which are nestable in the base assembly, standing upright on edge. Between the weight plates there is disposed a handle, with pins extendable in opposing axial directions.

The weight plates have connecting means which are formed in such a manner that they interconnect, in the axial direction, neighbouring weight plates, but permit a radial displacement between two neighbouring weight plates.

The handle has a U-shaped central section with a bottom plate, in which gears are disposed for projecting the above-mentioned pins or rods.

The weight disks are complex in configuration and asymmetric, which implies that the total point of gravity of the dumbbell will probably be far away from a central, longitudinal axis through the dumbbell. What is more serious is that the U-shaped handle presents a major risk factor, since the bottom portion of the handle, where the gears are accommodated, could strike the wrist of a user and injure the wrist, if the dumbbell were inadvertently to rotate in the user's hand. Furthermore, in certain embodiments, the weight disks at opposing ends of the dumbbell are united by the intermediary of interjacent rods which, naturally, also in themselves constitute a risk factor and which moreover make the dumbbell extremely uncomfortable to use.

A similar, and just as clumsy and hazardous a dumbbell is shown in U.S. Pat. No. 650,101.

It is desirable to improve the dumbbell described by way of introduction such that the drawbacks inherent in the prior art technology are obviated. In particular, it is desirable to design the dumbbell so that there are no risks of injury regarding the wrist of the user and, naturally, the dumbbell will be comfortable to use. Further, it is desirable to design the dumbbell so that the point of gravity of the dumbbell in the circumferential direction will be somewhere along the longitudinal centre axis of the dumbbell, and finally that the dumbbell will be simple and economical to manufacture.

According to an aspect of the present invention, the dumbbell intimated by way of introduction is characterised in that the handle, at opposing ends, has connecting means for cooperation with the connecting means on the mutually most proximally located weight disks in the base assembly, that the space between the connecting means is free through 360° about the handle throughout the entire length thereof, and that the weight disks have through-going openings centrally located.

BRIEF DESCRIPTION OF THE ACCOMPANYING DRAWINGS

The present invention will now be described in greater detail hereinbelow, with reference to the accompanying Drawings. In the accompanying Drawings.

DETAILED DESCRIPTION

In purely general terms, the dumbbell according to the present invention belongs to that category of dumbbell which has a selectable number of weight disks 1 which are fixable on a handle 2 and which are intended, standing upright, to be accommodated in corresponding accommodation spaces 3 in a base assembly 4. The dumbbell is designed in such a manner that it is possible to lift up from the base assembly the handle with a selectable number of weight disks fixed on the handle.

Figure 1:
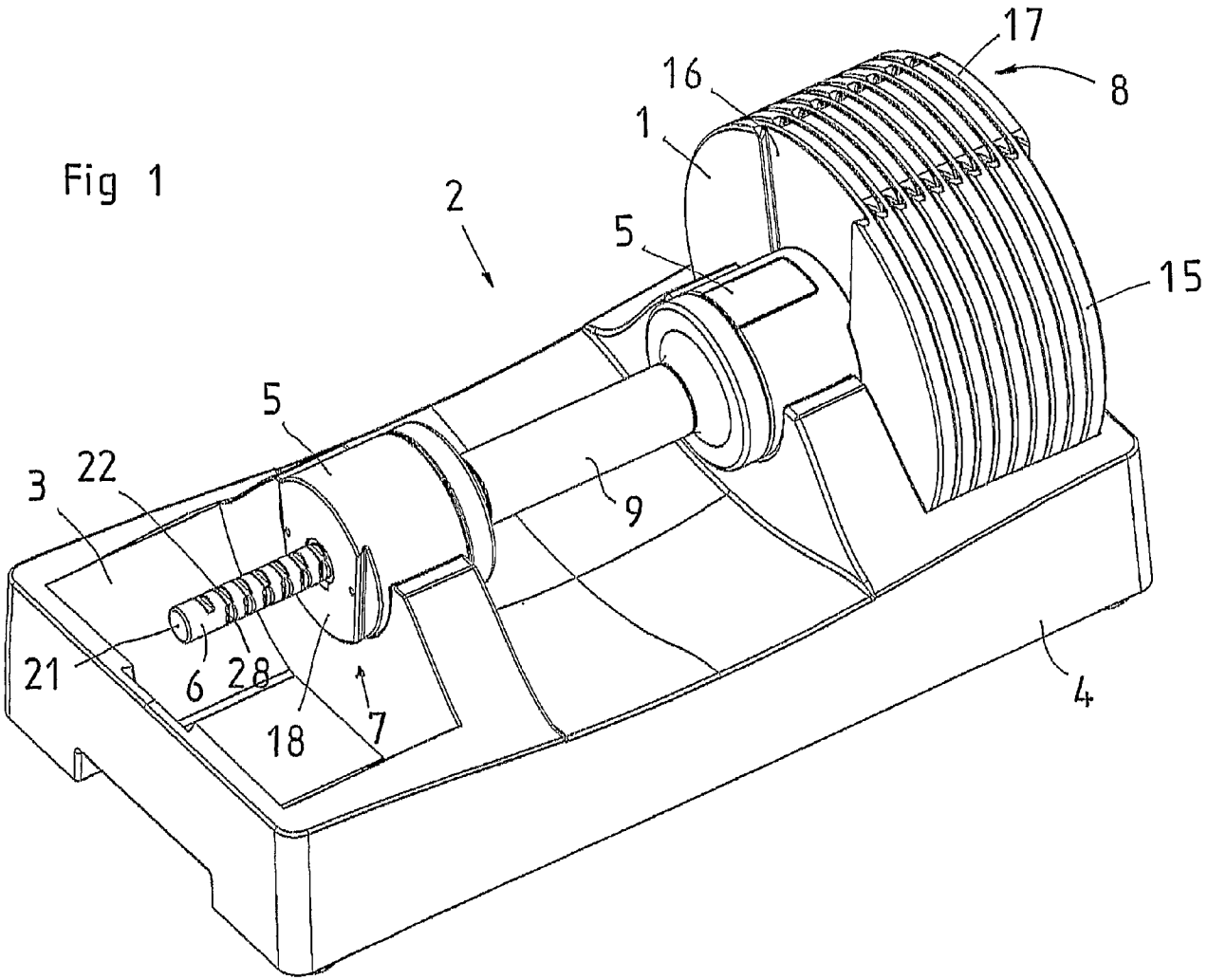
FIG. 1 is a perspective view of a base assembly in which is placed a handle included in a dumbbell and a set of weight disks which stand upright in the base assembly.

It will further be apparent from FIG. 1 that the handle 2 displays, at its opposing ends, housings 5 from which pin members 6 are disposed to be projectable in opposing directions in the longitudinal direction of the handle 2 and which are movable along the longitudinal centre axis of the handle. While not being apparent from FIG. 1 (see instead FIGS. 5, 6 and 7), the weight disks 1 have central openings 14 into which the pin members 6 are insertable. The purpose of the pin members is, by direct contact, abutment, to cooperate with and support the weight disks 1 when a dumbbell is lifted up out of the base assembly. In addition, the outer end sides of the housings 5 facing away from one another display connecting means 7 which are disposed for cooperation with corresponding connecting means 8 on the weight disks.

As is intimated in FIG. 1, the pin members 6 are suitably designed as solid rods of superior mechanical strength. Possibly, a tubular design may also come into consideration, in which event there may be accommodated interiorly in the pin members parts that are not described here. The free ends of the pin members are smooth, possibly slightly bevelled, and in this position lack transversely directed projecting parts such as, for example, flip-out locking devices so as to facilitate entry into the weight disks.

The connecting means are designed in such a manner that, in the axial direction, i.e. along a longitudinal centre axis to the handle, they interconnect neighbouring weight disks at the same time as they permit a radial displacement of one weight disk in relation to another (in FIG. 1 in the vertical direction, provided that the base assembly 4 rests on a horizontal substrate). The innermost weight disks are correspondingly interconnected to the connecting means 7 of the housings 5.

It follows from the foregoing that the number of weight disks which, in their central openings 14, have the pin members 6, can no longer carry out the radial movements, for which reason on lifting of the handle 2 out of the base assembly 4, this number of weight disks will accompany the handle up out of the base assembly.

The number of weight disks which is located outside the raised weight disks, and into whose central openings 14 the pin members 6 do not extend, is therefore not affected by the projecting pin members 6, for which reason these outer weight disks will remain in place in the base assembly 4.

In order to realise the above-considered axial projection of the pin members 6, there is disposed in the handle a screw mechanism which realizes the axial projection or retraction of the pin members 6 when a rotary section 9 between the housings 5 of the handle is turned in relation to the housings about the longitudinal centre axis of the handle.

In order to define and/or display such projection lengths for the pin members 6 as correspond to a complete number of weight disks, the handle 2 of the dumbbell includes one or more indexing devices which will be described in greater detail hereinbelow. The purpose of the indexing device is thus to facilitate a gradual projection of the pin members 6 by correct step lengths.

Figure 8:
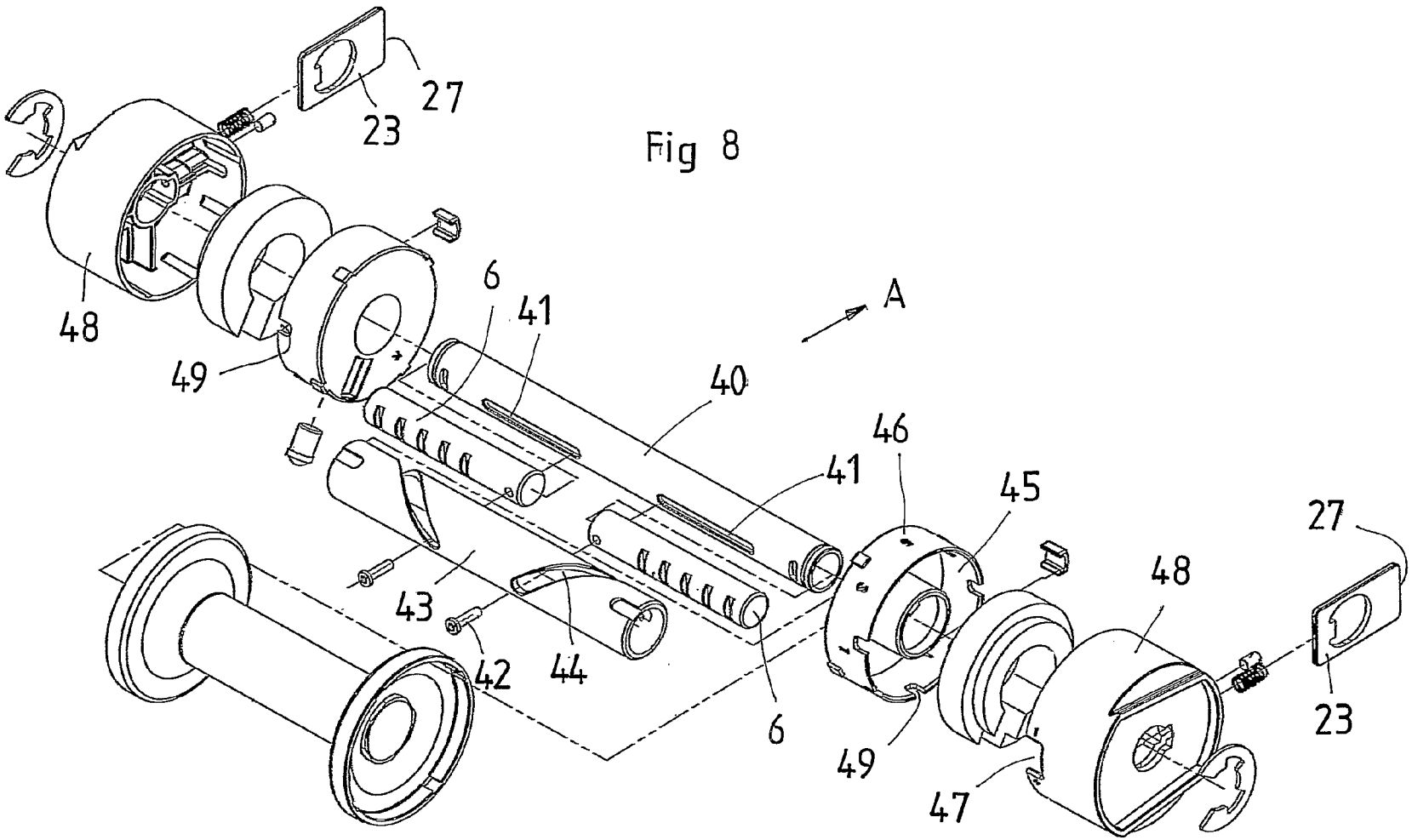
FIG. 8 is an exploded view of a handle, however in a slightly modified version, the distal side in FIG. 8 being turned to face downwards in accordance with the arrow A when the handle lies in the base assembly.

It will be apparent from FIG. 8 that the handle has an inner tube 40 with two longitudinal apertures 41. The pin members 6 which, in this embodiment, are solid metal rods, are longitudinally displaceable interiorly in the inner tube 40 and have pins 42 which extend out through the apertures, whereby the pin members 6 are prevented from rotating in relation to the inner tube 40. Outside the inner tube 40, there is provided an outer tube 43 with two helical grooves, in which the pins 42 are accommodated. The above-described design and construction implies that when relative rotation takes place between the inner 40 and the outer 43 tubes, the pin members 6 will move axially in the longitudinal direction.

Outside the outer tube 43, there is disposed a rotary portion 9 which the user of the dumbbell manually twists when a choice is made of the number of weight disks 1 on the dumbbell.

The rotary portion 9 is rotationally interconnected with an index ring 45, which is included in the above-discussed indexing device and which displays, along its periphery, markings 46 for the number of weight disks to be accommodated on the dumbbell. The markings 46 are shown in an opening 47 in the outer casing 48 of the housings 5, the outer casing being positionally fixed in the direction of rotation when the dumbbell rests in the base assembly 4 and, moreover, the outer casing is rotationally interconnected with the inner tube 40.

Figure 3:
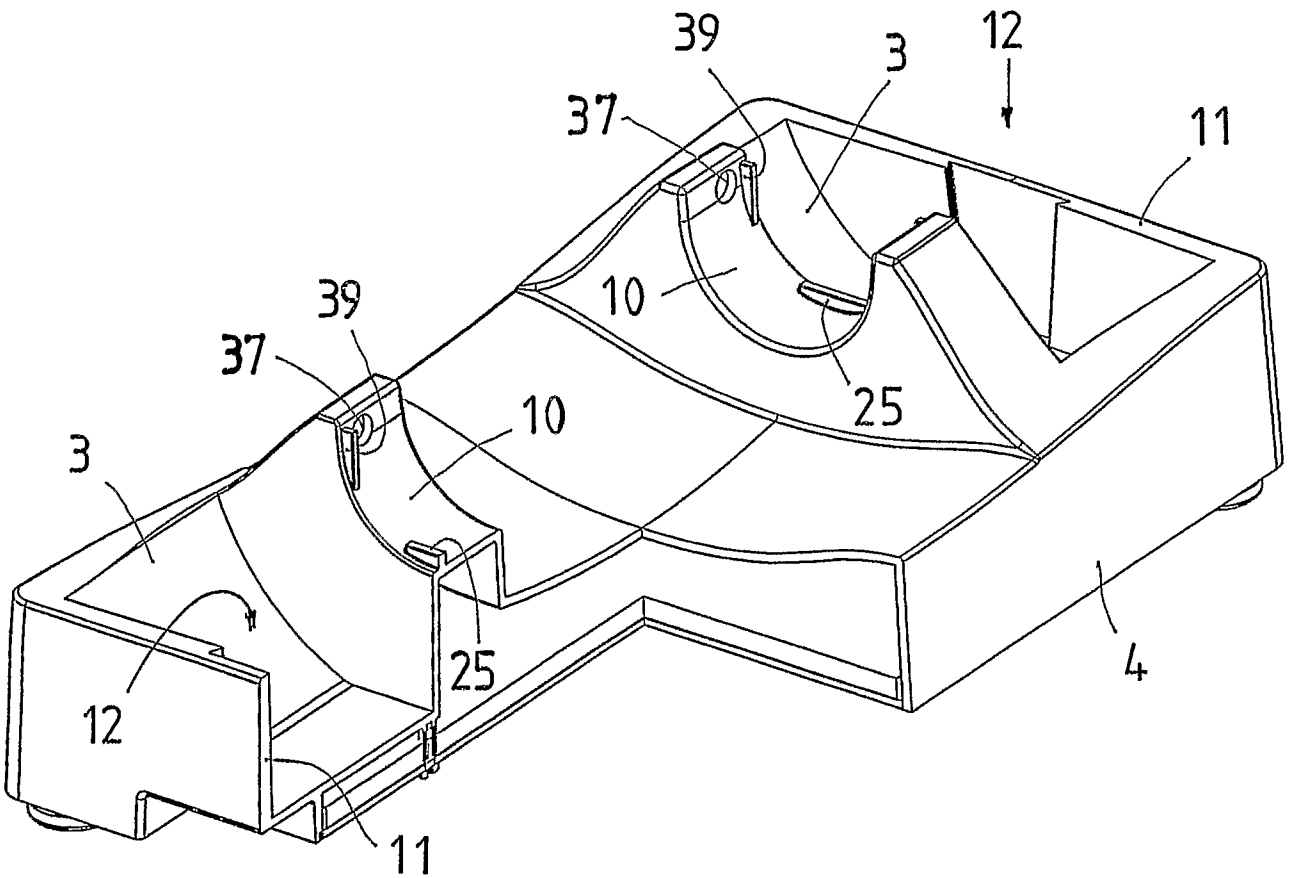
FIG. 3 shows the base assembly of FIG. 1 in the partly cut-away state and without handle and weight disks.

It will be apparent from FIG. 3, which shows an embodiment modified in relation to that of FIG. 8, that the base assembly 4 has two seats 10 for accommodating and positionally fixing the housings 5 of the handle 2, in particular its outer casing 48. In addition, the base assembly 4 has, at its opposing ends, accommodation spaces 3 each for accommodating a set of weight disks 1. Furthermore, the end walls 11 of the base assembly 4 are provided with connecting means 12 for cooperation with the corresponding connecting means 8 on both of the outermost of the weight disks standing upright in the base assembly. Hereby, the weight disks will be positioned in the direction of rotation in relation to the base assembly 4.

The housings 5 and the seats 10 have mutually cooperating positioning means 38, 39 by means of which the handle 2 (apart from its gripping portion 9) is positioned in the direction of rotation about the longitudinal centre axis of the handle in relation to the base assembly when the handle is in position in the base assembly. This position of rotation defined in relation to the base assembly also implies that the connecting means 7 of the housings 5 are located in the correct position in relation to the connecting means of the weight disks when the weight disks stand upright in the base assembly, since the connecting means 8 of the outermost weight disks cooperate with the connecting means 12 on the end walls 11 of the base assembly. The positioning means are in the form of grooves 38 in the housings 5, and projections 39 in the seats 10 insertable in the grooves.

According to the present invention, it is possible to dispense with the positioning means 38 and 39, since the handle 2 of the assembly and the weight disks 1 are also aligned in the direction of rotation about the longitudinal centre axis of the dumbbell by cooperation between the connecting means 8 of the weight disks 1 and the connecting means 12 of the base assembly 4, or alternatively between corresponding connecting means on the weight disks.

Figure 5:
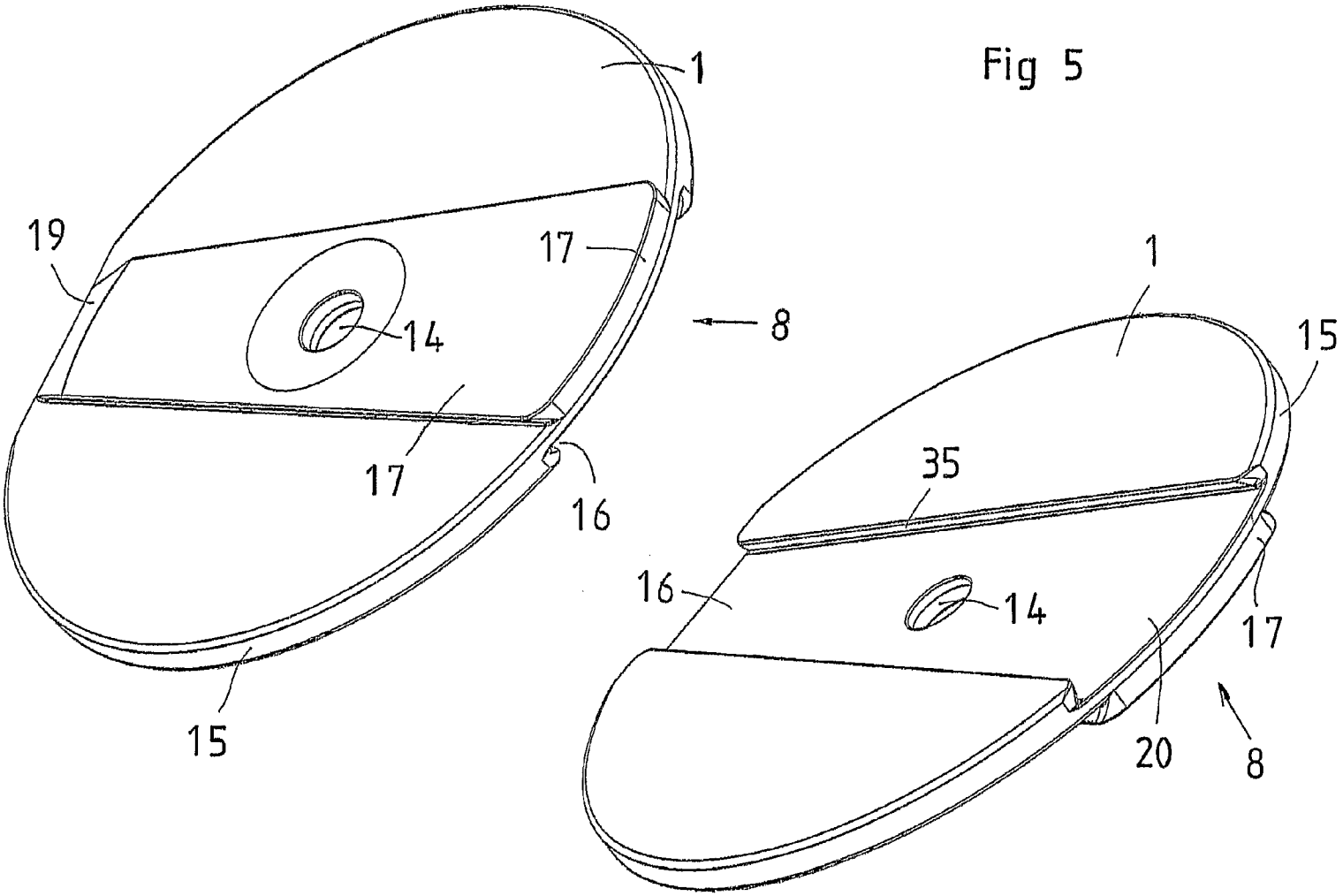
FIG. 5 shows two different perspective views of a weight disk.
Figure 6:
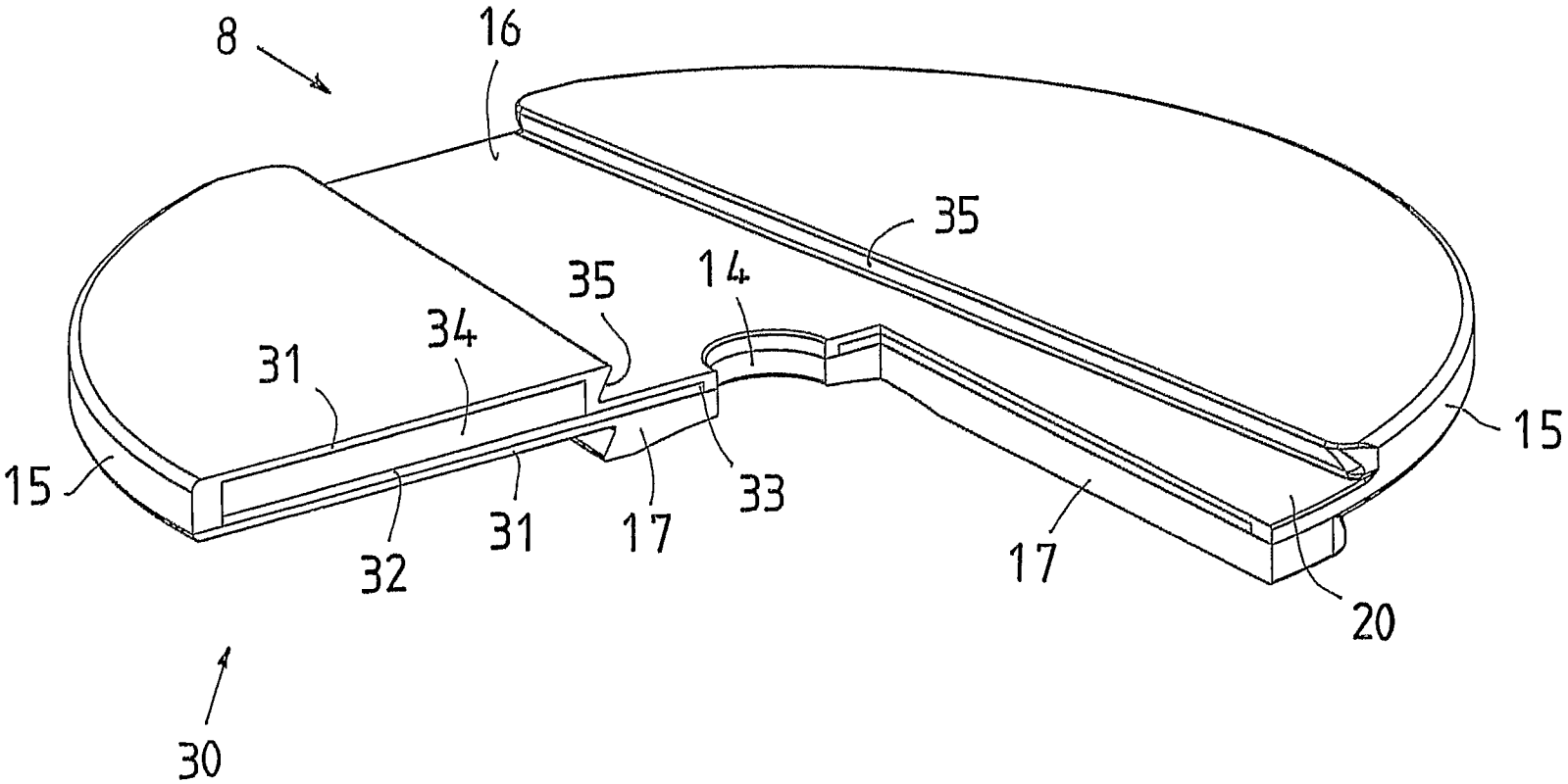
FIG. 6 shows a weight disk according to FIG. 5 in the partly cut-away state.

It will be apparent from FIGS. 5 and 6 taken together that the weight disks are substantially circular, planar disks with central openings 14 for accommodating the pin members 6 on the handle 2. Furthermore, the weight disks 1 have substantially circular peripheral edges, which are unbroken and which extend throughout the entire periphery of the whole of the weight disk. Otherwise expressed, the central openings 14 have no communication whatever with the peripheral edges of the weight disks in the form of grooves, recesses or the like.

It will be further apparent from FIGS. 5 and 6 that the connecting means 8 of the weight disks 1 include a depression 16 on the one side of the weight disk and a corresponding projection 17 on the opposing side of the weight disk. Preferably, the projections 17 and the recesses 16 are complementary to one another, although this is not absolutely critically necessary. Both the projections and the recesses have a longitudinal centre line, which is also a diameter line for the weight disk through the central opening 14. In the longitudinal direction of this centre line, both the depressions 16 and the projections 17 are cuneiform, symmetrically about the longitudinal centre line. Further, the cross-sectional configuration in the depressions 16 is undercut, for example dovetailed, the projections 17 having a corresponding profile. This implies that when two weight disks are interconnected with the projection 17 on the one weight disk accommodated in the depression 16 on the other weight disk, the weight disks can no longer be displaced in the axial direction in relation to one another. On the other hand, they are displaceable only in one direction along the above-mentioned longitudinal centre line to the projection 17 and the depression 16. This longitudinal centre line is vertical when the weight disks are in position upright in the base assembly 4 (see FIG. 1) and in the direction of rotation are aligned by cooperation between the projections 17 of the outermost weight disk and the connecting means of the base assembly 4.

Figure 7:
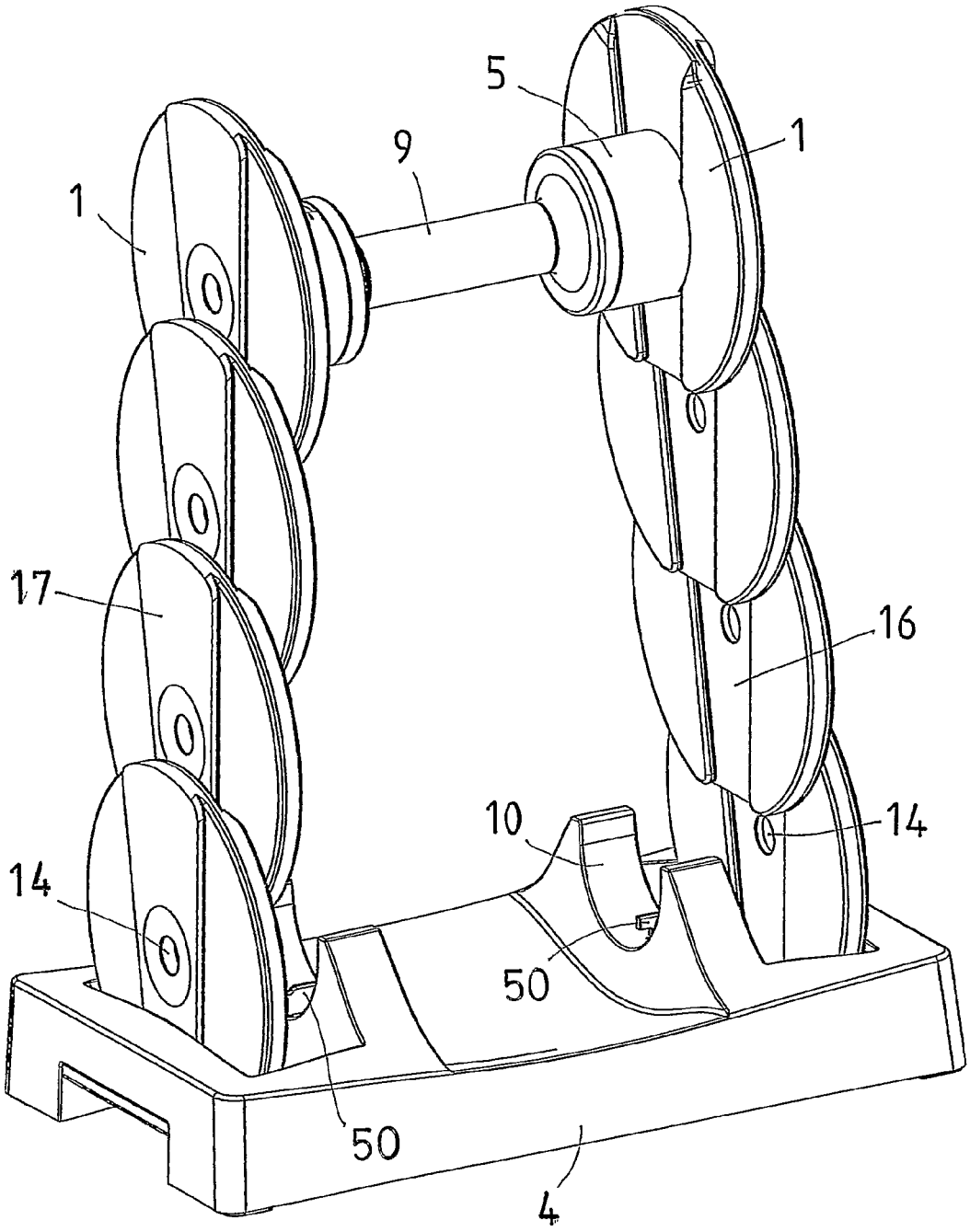
FIG. 7 is an exploded view showing a base assembly and a number of weight disks which are placed therein.

It will be apparent from FIGS. 1 and 7 that when the weight disks 1 are standing in the base assembly 4 or are just about to lifted up out of or deposited down into the base assembly, the widest ends of the projections 17 and recesses or depressions 16 are turned to face upwards, for which reason an inner weight disk 1 (located more proximal the handle 2) can always be lowered down into or lifted up out of an outer weight disk, as long as the pin members 6 do not extend through the central openings 14 in both of these weight disks.

Figure 2:
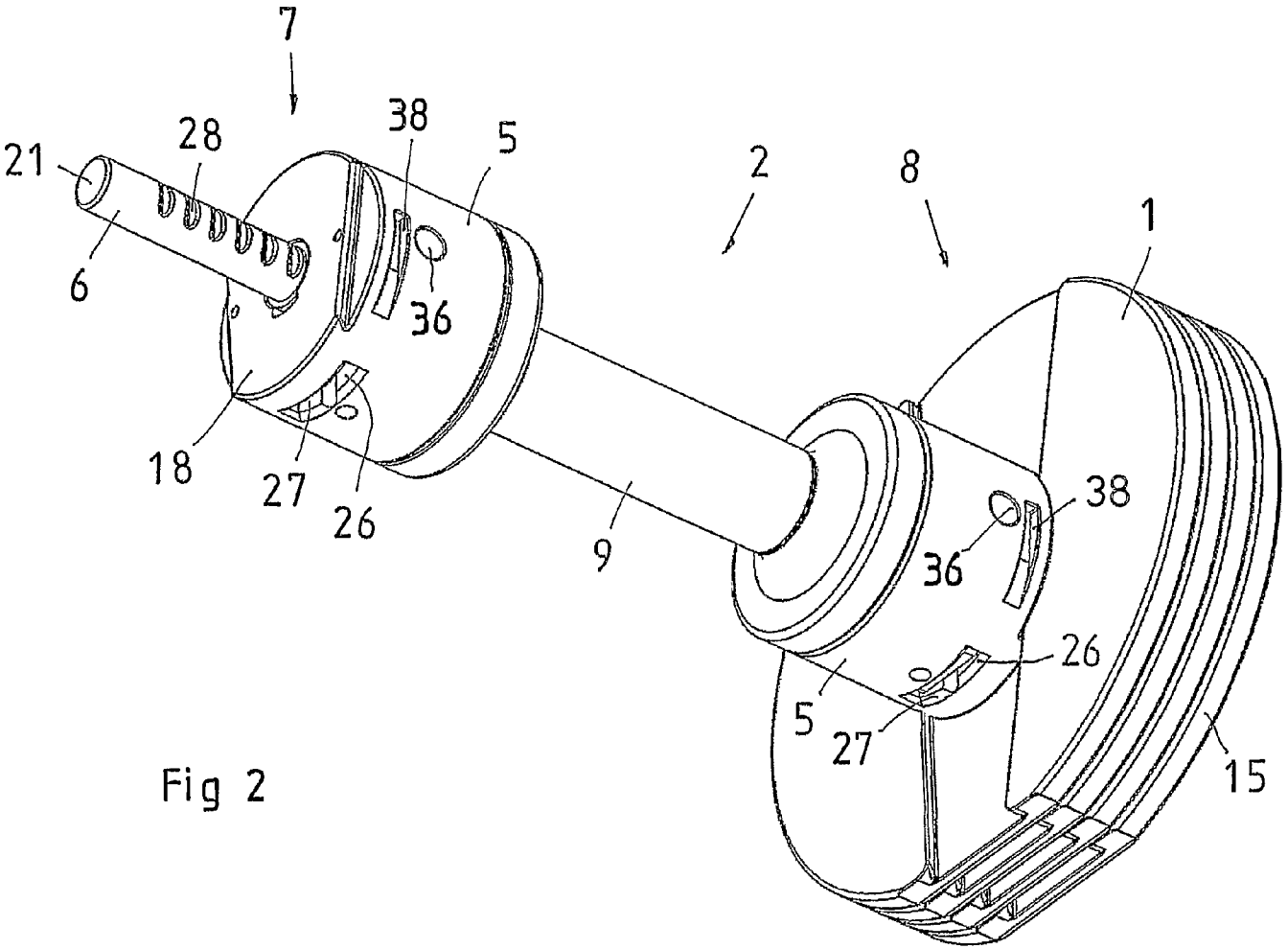
FIG. 2 shows the handle of FIG. 1, seen obliquely from beneath together with weight disks disposed on the handle.

It will be apparent from FIG. 2 that the housings 5 have a corresponding design of their connecting means 7, viz. projections 18, which may be said to correspond to a part of the projection 17 on a weight disk and which therefore fit into the depressions 16 on both of the innermost weight disks 1.

It will be apparent from FIG. 5 that the projection 17 on the weight disk has, in its narrower end, a change bevel 19 whose purpose is to facilitate insertion of the projection 17 in a corresponding depression 16 on an adjacent weight disk. It will further be apparent that the depression 16 is open all the way out to the peripheral edge of the weight disk so that the projection on an adjacent weight disk can thereby readily be passed down in the wider end 20 of a depression 16.

As was considered above, both of the pin members 6 are projectable in opposing axial directions from the handle 2 by rotation of the rotary portion 9 of the handle in relation to the housings 5 of the handle which, in the direction of rotation, is positionally fixed in the base assembly 4 via the projections 18 of the housings 5 and the depressions 16 and projections 17 of the weight disks 1, the projection 17 of the outermost weight disk being accommodated in the connecting means 12 of the base assembly 4. Since this axial projection takes place with the aid of a screw mechanism, the projection will be continuous as a function of the angle of rotation of the rotary portion 9. It will readily be perceived that only certain projection lengths of the pin members are desirable, namely such projection lengths as imply that the end surfaces 21 of the pin members 6 are located immediately inside an outer side of a weight disk 1 standing upright in the base assembly. Setting of such projection lengths is made possible or facilitated by the above mentioned indexing devices. With such a projection length, all weight disks inside the relevant weight disk in the radial direction will have complete support from the pin member 6 and the outermost weight disk has as good support as it is possible to achieve. On the other hand, the weight disk lying outside is wholly unaffected by the pin member 6.

Figure 4:
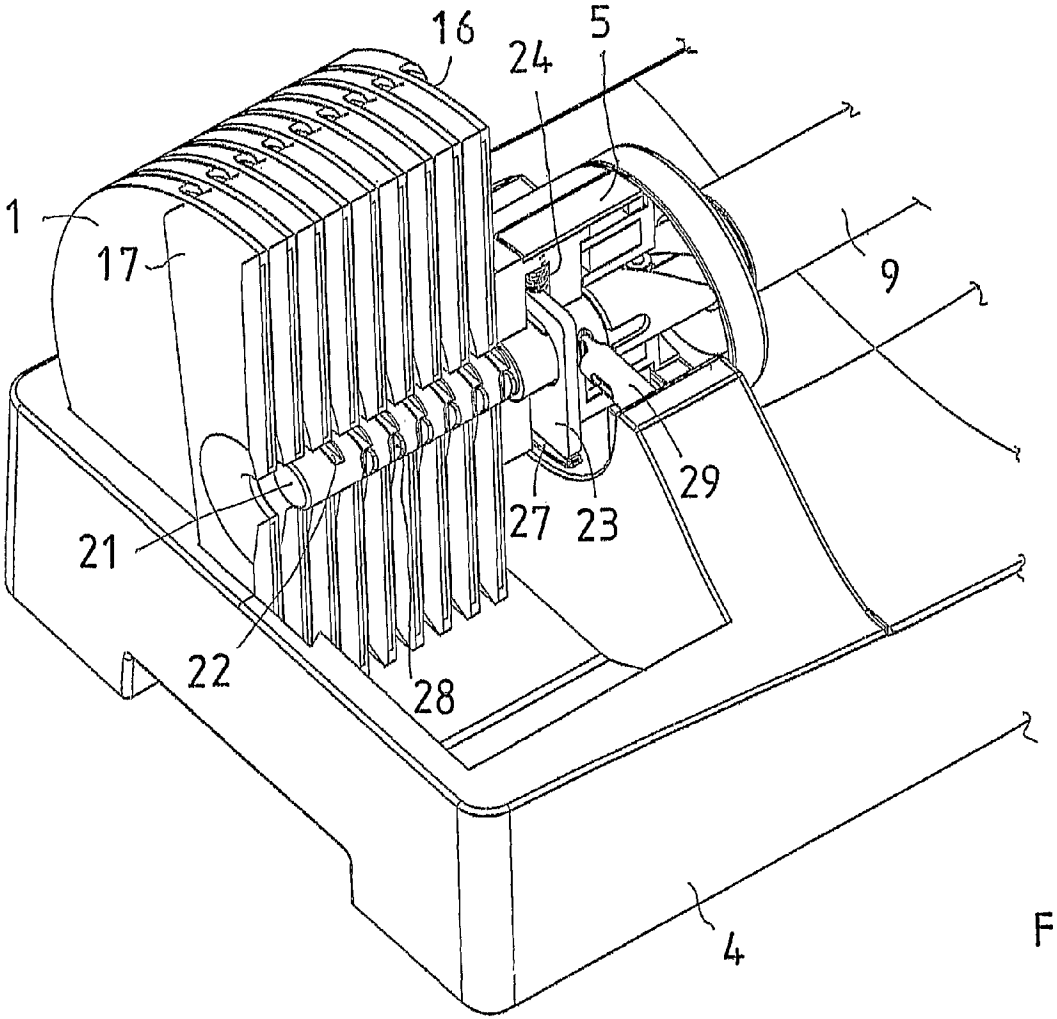
FIG. 4 shows in the partly cut-away state the base assembly of FIG. 1 with a handle disposed therein and a set of weight disks.

In order to ensure that, on using a raised dumbbell, no relative rotation takes place between the rotary portion 9 and the weight disks connected to the housings 5, for example because of the flywheel effect of the weight disks, which might possibly entail that the pin members 6 are retracted to some extent, so that at least the outermost weight disks are free and will fall off the dumbbell, both of the housings 5 have locking means which, in selected projection lengths, lock the pin members in the axial direction as soon as the dumbbell is lifted out of the base assembly 4. To this end, both of the pin members 6 have a first series of recesses 22 (FIGS. 1 and 4), where the distance between adjacent recesses corresponds to the thickness of one weight disk 1. Interiorly in both of the housings 5, there are provided, as will be apparent from FIGS. 4 and 8, sliding portions 23 with openings through which the pin members 6 extend. The sliding portions 23 are spring-biased by means of springs 24 in a downward direction when the dumbbell rests in the base assembly 4. In such instance, the sliding portions 23 have edges which, under the action of the springs 24, strive to snap down into one of the recesses 22 so that, as a result, the pin members are locked in the axial direction as a result of the engagement between the recesses 22 and the sliding portions 23.

In order to permit outward pivoting of both of the pin members 6 when the dumbbell rests in the base assembly 4, blocking means are provided which block the locking function of the locking means, but which cease to function as soon as the dumbbell is lifted out of the base assembly 4. The blocking means are in the form of upstanding heels 25 which are disposed on the seats 10 in the base assembly 4. The heels 25 are disposed to extend in through openings 26 in the lower sides of the housings 5 when the housings rest in the seats 10 (FIG. 2). When the heels 25 in this manner extend in to the interior of the housings, they come into contact with lower end portions 27 on the above-mentioned sliding portions 23 so that these are lifted a sufficient distance against the action of the springs 24 to become disengaged from the recesses 22 of the pin members 6.

In the foregoing, it was mentioned that the projection of both of the pin members in the axial direction takes place in a continuous movement by rotation of the rotary portion 9 of the handle in relation to the housings 5. In order to obtain stepwise projection lengths of the pin members which correspond to the locking positions for the locking means and where, as was mentioned above, the end surfaces of the pin members are located immediately inside the outer sides of the relevant weight disks, the present invention includes, as was mentioned above, an indexing device which gives stepwise setting possibilities in the longitudinal direction of the pin members 6. This indexing device comprises a second series of recesses 28 on the pin members 6, where the distance between adjacent recesses in the first and the second series mutually corresponds and corresponds to the thickness of one weight disk. The recesses 28 in the second series have V-shaped or circular cross section in order to avoid an excessively powerful locking function. Interiorly in each one of the housings 5, there is further provided a snap portion 29 (FIG. 4) which, under the action of a spring (not shown in this Figure), is movable into engagement with one of the recesses 28. In such instance, the design and formation of the end of the snap portion 29 facing towards the pin members and the formation of the recesses 28 are such that an accurate stepwise projection of the pin members can take place without the resistance being excessively great on "unscrewing" of the pin members.

The snap portions 29 fulfil a further function, namely that of preventing lifting of the handle 2 out of the base assembly 4 when the pin members 6 are located in "incorrect" positions. It will be apparent from FIG. 2 that the housings 5 have openings 36 through which the snap portions 29 can extend out when the inner end regions of the snap portions are located in abutment against the pin members 6 between two of their recesses 28. When the snap portions 29 by such means extend outside the peripheries of the housings 5, their projecting portions will be accommodated in corresponding recesses 37 in the seats 10 of the base assembly 4 in order thereby to prevent lifting of the handle 2 out of the base assembly with incorrect projection lengths of the pin members 6.

FIG. 8 shows a slightly modified embodiment, where the one series of recesses 28, the snap portion 29, the opening 36 as well as the recess 37 are omitted. The correct projection length for the pin members 6 is realised in this embodiment in that there are disposed recesses 49 along the peripheries of the index rings 45 at equal spacing in the circumferential direction. On the seats, catch-shaped projections 50 are provided which, through openings from beneath, extend into the housings 5 when the dumbbell rests in the base assembly 4. The projections have shanks which are substantially parallel with the centre axis of the handle 2 and which grasp interiorly about the peripheral edge of the index rings 45. When these projections are located between the recesses 49 of the index rings 45, they prevent a lifting of the dumbbell up out of the base assembly 4.

When, on the other hand, the projections 50 are located in register with any of the recesses 49, lifting may take place. In such positions, the index ring 45, and thereby the gripping portion 9 and the outer tube 43 are in such positions of rotation that the outer end surfaces 21 of the pin members 6 are located immediately inside the outsides of two weight disks 1. That number of weight disks which is thus carried by the pin members 6 is displayed as a corresponding marking 46 in the opening 47 of the housing 5.

As is apparent from FIGS. 5 and 6, the weight disks are separate units which, apart from the connecting means 7 and 8, are not interconnected via any struts or rods, which is a common prior art practice when such struts or rods are used for pairwise interconnection of two weight disks, one at each end of the dumbbell. This implies that, according to the present invention, the space through 360° about the handle 2 is completely free throughout the entire length of the handle in principle between the connecting means 7 of the housings 5. This is a crucial feature in the subject matter of the present invention, since such connection struts or rods could hit and injure the wrist of a user if the dumbbell, because of its considerable flywheel effect, were to twist or pivot in the grip of the user.

According to the present invention, both of the pin members 6 are disposed coaxially, with a longitudinal centre line to the handle 2 and coaxially in relation to the circumferential surfaces of both of the housings 5. Since the openings 14 of the weight disks 1 are disposed coaxially with the peripheral edges 15 of the weight disks, the dumbbell, as thus far described, will be rotationally symmetrical as regards the position of the point of gravity.

It will be apparent from FIGS. 5 and 6, primarily FIG. 6, that each weight disk has a core 30 of a relatively heavy, first material and an outer layer 31 surrounding the core, of a second material. The core 30 comprises a substantially planar, relatively thin and circular disk 32 of metal, preferably steel, which has a central opening 33 which is coaxial with the central opening 14 of the weight disk and which may appropriately be slightly larger than it. On that side of the disk 32 where the depression 16 of the disk is disposed, there are secured substantially circle-segment shaped weight portions 34, which are of considerably greater thickness than the disk 32. In the radial direction, the weight portions 34 extend in to the immediate proximity of the longitudinal, slanting edges 35 which, on both sides, define the depression 16 of the weight disk. The relatively slight cuneiform configuration which the depressions 16 and the projections 17 have on the weight disk entails that the total point of gravity of the weight disk will but insignificantly deviate from the centre of the through-going opening 14. Further, the edges of the weight portions 34 facing towards the depressions 16 have a supporting effect against the opposing edges 35 of the depression.

The outer layer 31 of the weight disk is suitably manufactured by injection moulding of plastic around the core 30. This implies that the projections 17 of the weight disks also consist of or comprise plastic. Further, the central opening 14 is surrounded by a plastic layer.

What is claimed is:

1. A dumbbell with a base assembly, comprising the base assembly, a plurality of weight discs adapted to stand upright in the base assembly, the dumbbell, the dumbbell comprising a handle having opposing ends, wherein, at each end of the handle, a selectable number of the weight disks standing upright in the base assembly are securable to the handle, the weight disks having through-going openings which are disposed in alignment with one another when the weight disks stand in the base assembly, and the weight disks have mutually cooperating connecting means which, in an axial direction of the dumbbell, interconnect neighboring weight disks so that neighboring weight disks are not axially displaceable relative to each other, but in a radial direction permit separation of one weight disk from a neighboring weight disk, wherein the weight disks have a closed peripheral edge entirely surrounding the through-going openings, and the handle having pin members projectable in opposing axial directions and insertable into the through-going openings in the weight disks, wherein, by selection of axial projection lengths of the pin members, a number of weight disks on the dumbbell is selectable from zero up to a desired number of weight disks, wherein the handle has, in the opposing ends, handle connecting means for cooperation with the connecting, means on the mutually most proximally located weight disks in the base assembly, a space between the handle connecting means is clear of structure except for the handle, and the through-going openings are centrally located on the weight disks, and wherein the handle has a diameter that is less than a diameter of any weight disc of the plurality of weight discs.

2. The dumbbell as claimed in claim 1, wherein the handle has, at its opposing ends, housings which have the connecting means of the handle at sides of the housings and facing away from one another; the base assembly has seats for accommodating the housings, and the housings and the seats have means for positional determination of the handle in a direction of rotation about the longitudinal axis of the handle.

3. The dumbbell as claimed in claim 2, wherein the housings are substantially cylindrical and coaxial with the handle.

4. The dumbbell as claimed in claim 3, wherein the pin members are substantially coaxial with one another and projectable by means of a screw device by rotation of a rotary portion at a central region of the handle in relation to the housings of the handle.

5. The dumbbell as claimed in claim 2, wherein the pin members are substantially coaxial with one another and projectable by means of a screw device by rotation of a rotary portion at a central region of the handle in relation to the housings of the handle.

6. The dumbbell as claimed in claim 2, wherein the connecting means of the weight disks are located on both sides of the openings of the weight disks.

7. The dumbbell as claimed in claim 2, wherein the peripheral edge of the weight disks is substantially circular peripheral edge.

8. The dumbbell as claimed in claim 7, wherein the weight disks and the base assembly are provided with means for positional determination of the weight disks in a direction of rotation about a common longitudinal axis of the openings in the plurality of weight disks when the plurality of weigh disks stand upright in the base assembly.

9. The dumbbell as claimed in claim 2, wherein a permitted radial displacement direction of the connecting means coincides for all weight disks and the handle.

10. The dumbbell as claimed in claim 1, wherein the connecting means of the weight disks are located on both sides of the openings of the weight disks.

11. The dumbbell as claimed in claim 1, wherein the peripheral edge of the weight disks is substantially circular peripheral edge.

12. The dumbbell as claimed, in claim 11, wherein the weight disks and the base assembly are provided with means for positional determination of the weight disks in a direction of rotation about a common longitudinal axis of the openings in the plurality of weight disks when the plurality of weight disks stand upright in the base assembly.

13. The dumbbell as claimed in claim 1, wherein a permitted radial displacement direction of the connecting means coincides for all weight disks and the handle.

14. The dumbbell as claimed in claim 1, wherein the base assembly has seats for supporting the handle.

15. The dumbbell as claimed in claim 1, wherein the base assembly has structures that engage with the handle.

* * * * *